US011028517B2

(12) United States Patent
Smith

(10) Patent No.: US 11,028,517 B2
(45) Date of Patent: Jun. 8, 2021

(54) WASHING MACHINE APPLIANCE AND METHODS FOR OUT-OF-BALANCE DETECTION AND MITIGATION

(71) Applicant: Haier US Appliance Solutions, Inc., Wilmington, DE (US)

(72) Inventor: Darrin R. Smith, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 315 days.

(21) Appl. No.: 16/038,406

(22) Filed: Jul. 18, 2018

(65) Prior Publication Data

US 2020/0024787 A1 Jan. 23, 2020

(51) Int. Cl.

| | |
|---|---|
| ***D06F 37/20*** | (2006.01) |
| ***D06F 39/08*** | (2006.01) |
| ***D06F 34/18*** | (2020.01) |
| *D06F 21/00* | (2006.01) |
| *D06F 37/36* | (2006.01) |

(52) U.S. Cl.

CPC ..... *D06F 37/203* (2013.01); *D06F 34/18* (2020.02); *D06F 39/085* (2013.01); *D06F 21/00* (2013.01); *D06F 37/36* (2013.01); *D06F 2204/065* (2013.01); *D06F 2222/00* (2013.01)

(58) Field of Classification Search

None

See application file for complete search history.

(56) References Cited

U.S. PATENT DOCUMENTS

| | | | | |
|---|---|---|---|---|
| 6,842,928 | B2 | 1/2005 | Yang et al. | |
| 7,555,798 | B2 | 7/2009 | Kim et al. | |
| 7,958,584 | B2 | 6/2011 | Suell, II et al. | |
| 8,914,930 | B2 | 12/2014 | Chanda et al. | |
| 2008/0289118 | A1* | 11/2008 | Park | D06F 37/203 8/159 |
| 2016/0237610 | A1* | 8/2016 | Kim | D06F 33/00 |
| 2018/0016728 | A1* | 1/2018 | Davis | D06F 37/304 |
| 2018/0057988 | A1 | 3/2018 | Davis | |

FOREIGN PATENT DOCUMENTS

| | | | |
|---|---|---|---|
| EP | 2666899 | A1 | 11/2013 |

* cited by examiner

*Primary Examiner* — Cristi J Tate-Sims

(74) *Attorney, Agent, or Firm* — Dority & Manning, P.A.

(57) ABSTRACT

A washing machine appliance and a method of detecting and mitigating out-of-balance conditions includes obtaining a subwasher load weight after adding water to the wash tub and obtaining a displacement threshold based at least in part on the subwasher load weight. The wash basket is spun at a first, low speed and the displacement amplitude of the wash tub is measured using a measurement device, such as an accelerometer and gyroscope. The measured displacement amplitude is then compared to the displacement threshold and if the displacement amplitude exceeds the displacement threshold, an agitation element is rotated to agitate or redistribute the load of articles.

20 Claims, 8 Drawing Sheets

WASHING MACHINE APPLIANCE AND METHODS FOR OUT-OF-BALANCE DETECTION AND MITIGATION

FIELD OF THE INVENTION

The present subject matter relates generally to washing machine appliances, such as vertical axis washing machine appliances, and methods for detecting and mitigating out-of-balance conditions in such washing machine appliances.

BACKGROUND OF THE INVENTION

Washing machine appliances generally include a cabinet which receives a wash tub for containing water or wash fluid (e.g., water and detergent, bleach, or other wash additives). The wash tub may be suspended within the cabinet by a suspension system to allow some movement relative to the cabinet during operation. A wash basket is rotatably mounted within the wash tub and defines a wash chamber for receipt of articles for washing. A drive assembly is coupled to the wash tub and configured to selectively rotate the wash basket within the wash tub.

Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or an agitation element can rotate at various speeds to agitate or impart motion to articles within the wash chamber. During a spin cycle, the wash basket may be rotated at high speeds, e.g., to wring wash fluid from articles within the wash chamber.

A significant concern during operation of washing machine appliances is out-of-balance conditions within the wash tub. For example, articles and water loaded within a wash basket may not be equally weighted about a central axis of the wash basket and wash tub. Accordingly, when the wash basket rotates, in particular during a spin cycle, the imbalance in clothing weight may cause the wash basket to be out-of-balance within the wash tub, such that the axis of rotation does not align with the axis of the cylindrical wash basket or wash tub. Such out-of-balance issues can cause the wash basket to contact the wash tub during rotation and can further cause movement of the wash tub within the cabinet. Significant movement of the wash tub can, in turn, generate increased noise, vibrations, washer "walking," and/or cause excessive wear and premature failure of appliance components.

Various methods are known for monitoring load balances and preventing out-of-balance scenarios within washing machine appliances. Such monitoring and prevention may be especially important, for instance, during the high-speed rotation of the wash basket, e.g., during a spin cycle. However, such methods typically monitor load balance and detect out-of-balance states during the spin cycle, when the wash basket is already spinning at a high rate of speed. Accordingly, noise, vibration, movement, or damage may occur despite the out-of-balance detection.

Accordingly, improved methods and apparatus for monitoring load balance in washing machine appliances are desired. In particular, methods and apparatus which provide accurate monitoring and detection at earlier times during the wash cycle would be advantageous.

BRIEF DESCRIPTION OF THE INVENTION

Aspects and advantages of the invention will be set forth in part in the following description, or may be apparent from the description, or may be learned through practice of the invention.

In one exemplary embodiment, a method for operating a washing machine appliance is provided. The washing machine appliance includes a wash tub, a wash basket rotatably mounted within the wash tub for receiving a load of articles, an agitation element rotatably mounted within the wash basket, a measurement device mounted to the wash tub, and a motor mechanically coupled to the wash basket and the agitation element. The method includes flowing a volume of water into the wash tub, obtaining a subwasher load weight, and obtaining a displacement threshold based at least in part on the subwasher load weight. The method further includes operating the motor to spin the wash basket at a first speed, measuring a displacement amplitude of the wash tub using the measurement device, and determining that the displacement amplitude exceeds the displacement threshold. The method then includes operating the motor to rotate the agitation element to agitate or redistribute the load of articles in response to determining that the displacement amplitude exceeds the displacement threshold.

In another exemplary embodiment, a washing machine appliance is provided. The washing machine appliance includes a wash tub positioned within a cabinet, a wash basket rotatably mounted within the wash tub, the wash basket defining a wash chamber for receipt of a load of articles for washing, and an agitation element positioned in the wash basket. A motor is in mechanical communication with the wash basket and the agitation element, the motor being configured for selectively rotating the wash basket and the agitation element within the wash tub. A measurement device is mounted to the wash tub and a water control valve regulates a flow of water from a water supply into the wash tub. A controller is in operative communication with the motor, the measurement device, and the water control valve, and is configured for regulating the water control valve to flow a volume of water into the wash tub, obtaining a subwasher load weight, and obtaining a displacement threshold based at least in part on the subwasher load weight. The controller then operates the motor to spin the wash basket at a first speed, measures a displacement amplitude of the wash tub using the measurement device, and determines that the displacement amplitude exceeds the displacement threshold. The controller then operates the motor to rotate the agitation element and agitate or redistribute the load of articles in response to determining that the displacement amplitude exceeds the displacement threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
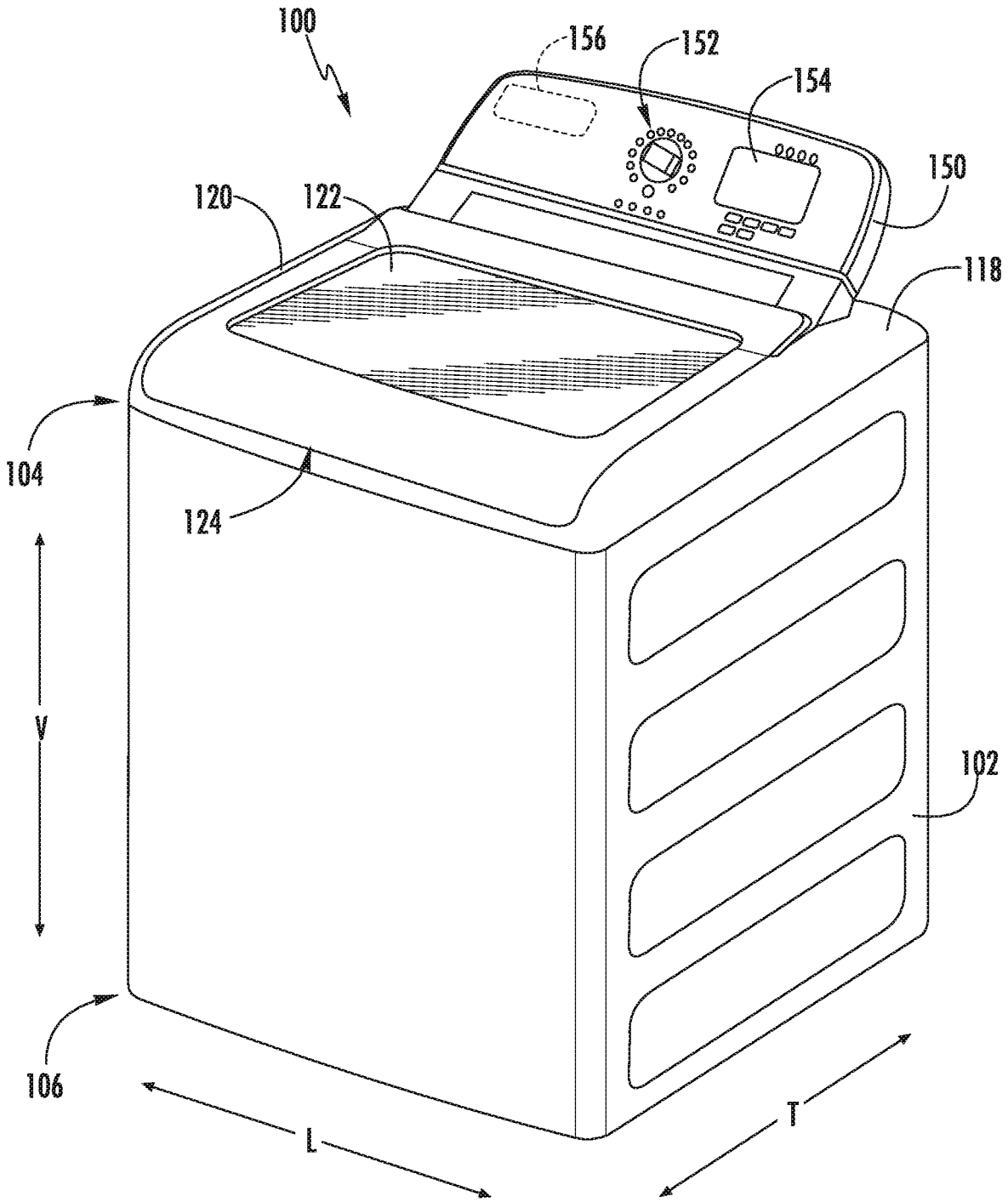
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
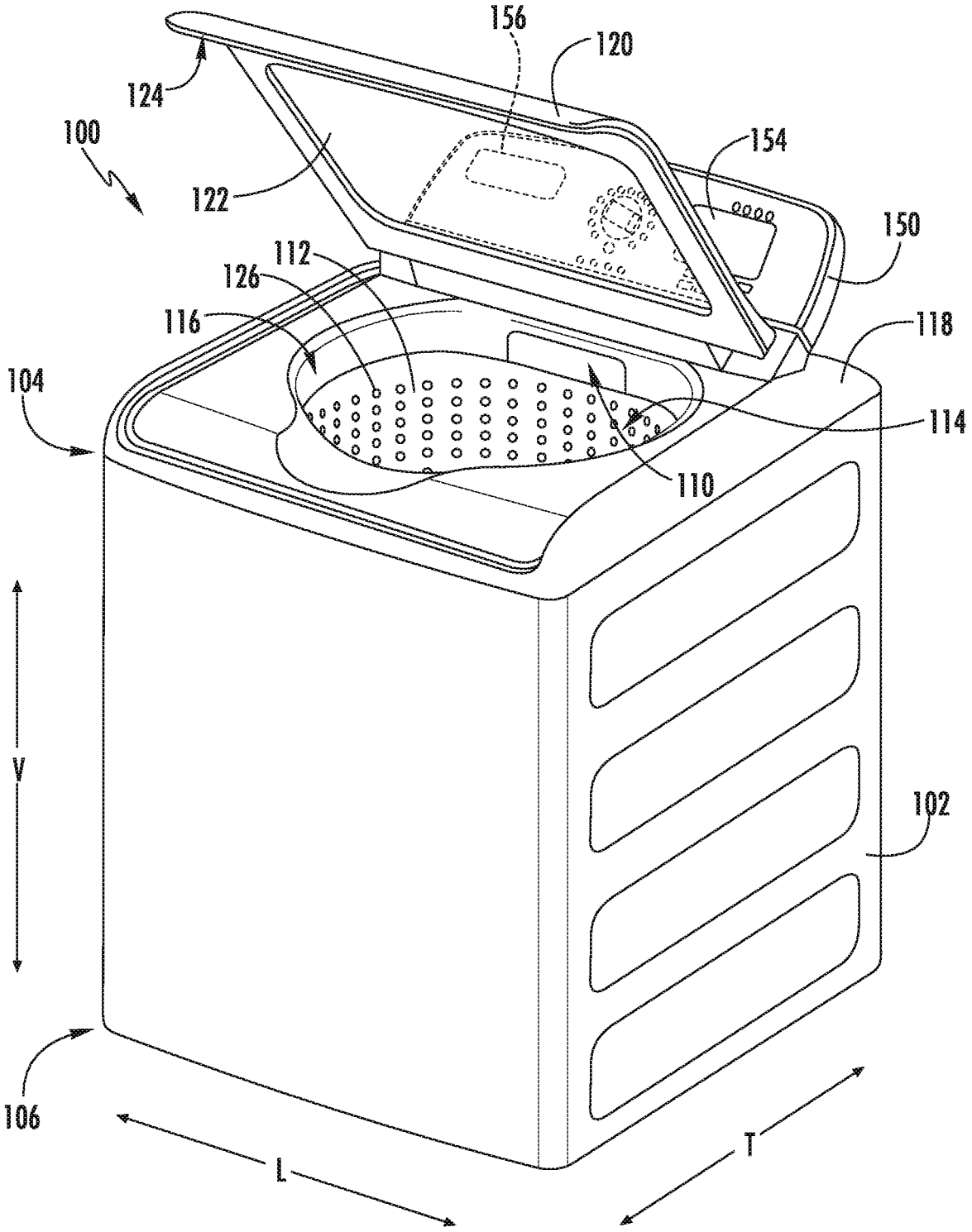
FIG. 2 provides a perspective view of the exemplary washing machine appliance of FIG. 1 with the door of the exemplary washing machine appliance shown in an open position.
Figure 3:
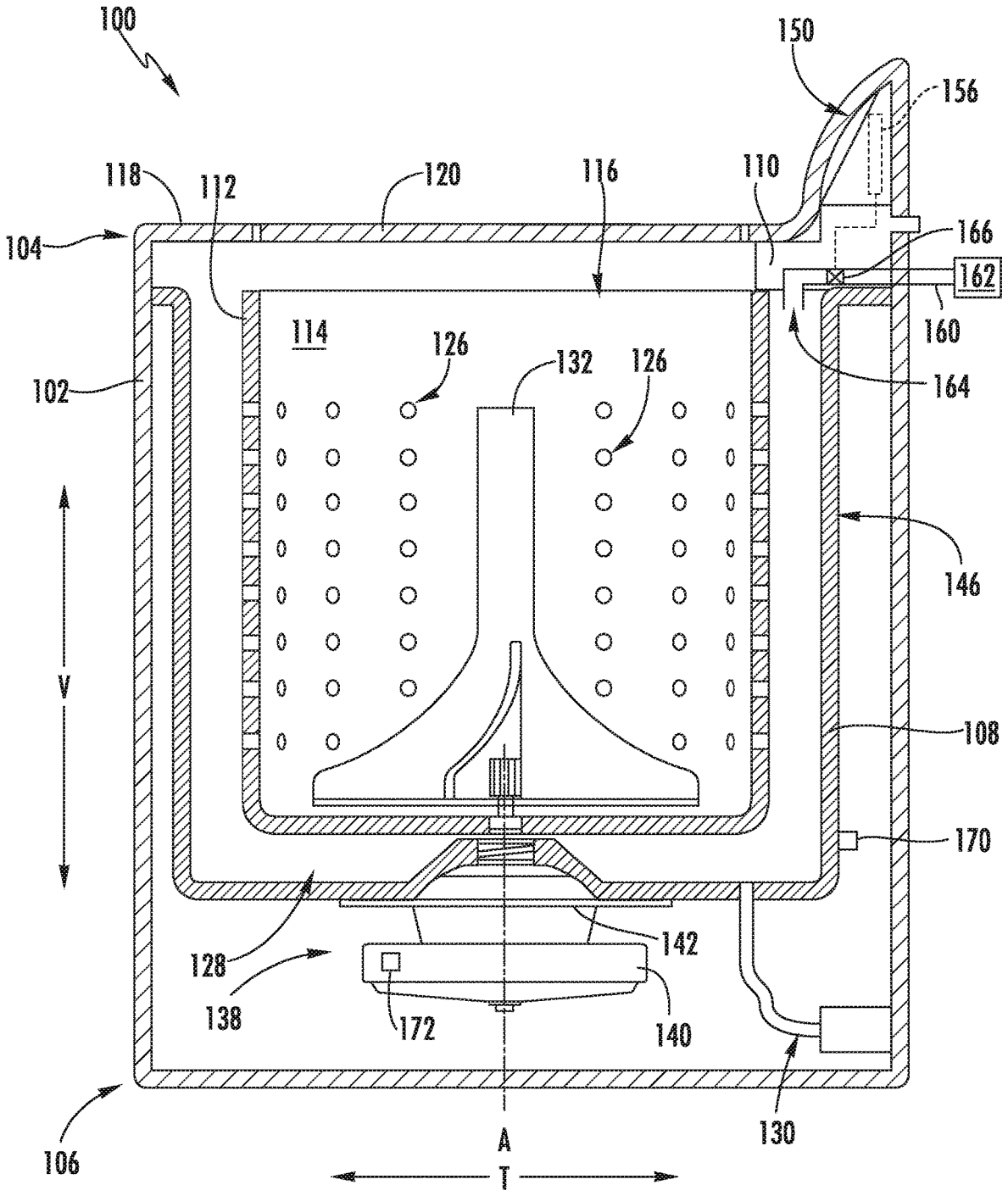
FIG. 3 provides a side, cross sectional view of the exemplary washing machine appliance of FIG. 1 according to an exemplary embodiment of the present subject matter.
Figure 4:
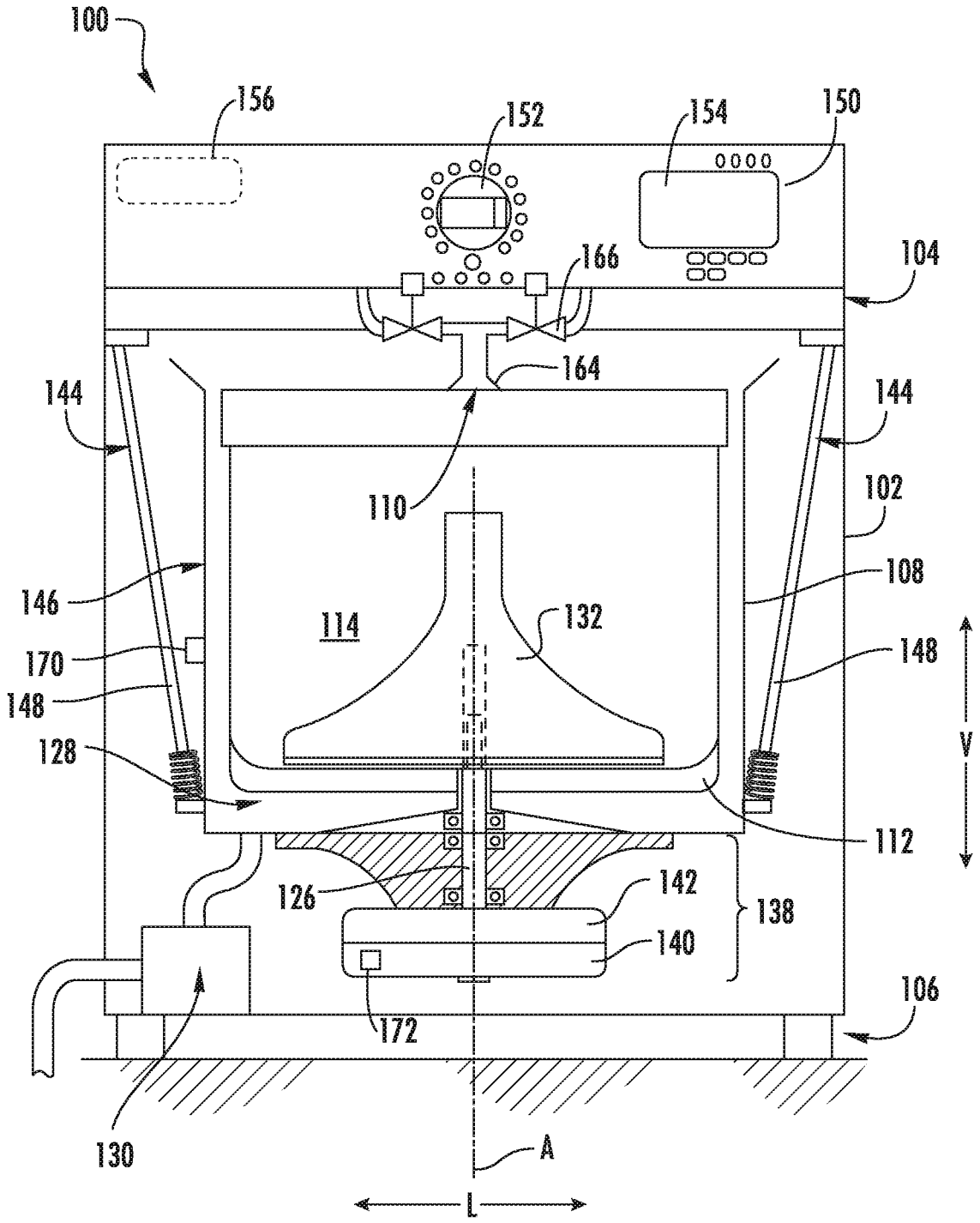
FIG. 4 provides a schematic, front view of the exemplary washing machine appliance of FIG. 1 according to example embodiments of the present subject matter.

FIGS. 1 through 4 illustrate an exemplary embodiment of a vertical axis washing machine appliance 100. Specifically, FIGS. 1 and 2 illustrate perspective views of washing machine appliance 100 in a closed and an open position, respectively. FIGS. 3 and 4 provide side and front cross-sectional views of washing machine appliance 100, respectively. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V. As best shown in FIG. 3, a wash tub 108 is positioned within cabinet 102 and is generally configured for retaining wash fluids during an operating cycle. Washing machine appliance 100 further includes a primary dispenser 110 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 112 that is positioned within wash tub 108 and generally defines a wash chamber 114 including an opening 116 for receipt of articles for washing. More specifically, wash basket 112 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well. As used herein, terms of approximation, such as "approximately," "substantially," or "about," refer to being within a ten percent margin of error.

As illustrated, cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user can access wash basket 112. A window 122 in door 120 permits viewing of wash basket 112 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and wash tub 108. In this regard, wash basket 112 is spaced apart from wash tub 108 to define a space for wash fluid to escape wash chamber 114. During a spin cycle, wash fluid within articles of clothing and within wash chamber 114 is urged through perforations 126 wherein it may collect in a sump 128 defined by wash tub 108. Washing machine appliance 100 further includes a pump assembly 130 (FIG. 3) that is located beneath wash tub 108 and wash basket 112 for gravity assisted flow when draining wash tub 108.

An impeller or agitation element 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitation element 132 extends into wash basket and assists agitation of articles disposed within wash basket 112 during operation of washing machine appliance 100, e.g., to facilitate improved cleaning.

In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 112 are oriented to rotate about axis of rotation A (which is substantially parallel to vertical direction V).

As best illustrated in FIGS. 3 and 4, washing machine appliance 100 includes a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitation element 132. In this manner, drive assembly 138 may be configured for selectively rotating or oscillating wash basket 112 and/or agitation element 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Turning briefly to FIG. 4, washing machine appliance 100 may include a vibration damping system or suspension system 144 which generally operates to damp or reduce dynamic motion and absorb vibrations of a subwasher 146. As used herein, the term "subwasher" is used generally to refer to those components of a washing machine appliance suspended within the appliance cabinet by a suspension system or assembly. For example, according to the illustrated embodiment, a subwasher 146 is suspended within cabinet 102 by suspension system 144 and includes wash tub 108, wash basket 112, agitation element 132, drive assembly 138, and other components.

Suspension system 144 can include one or more suspension springs 148 for supporting subwasher 146 and absorbing the forces resulting from the movement of wash basket 112 within the tub 108. Specifically, according to an exemplary embodiment, suspension system 144 includes four suspension springs 148 which are spaced apart about the wash tub 108. For example, each suspension springs 148 may be connected at one end proximate a corner of cabinet 102 and at an opposite end to wash tub 108.

According to alternative embodiments, washing machine appliance 100 may further include other vibration dampening elements, such as balance rings positioned at around the upper and/or lower circumferential surfaces of the wash basket 112. Balance rings may be used to counterbalance an out-of-balance condition for washing machine appliance 100 as wash basket 112 rotates within wash tub 108.

Referring still to FIGS. 1 through 4, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. As described in more detail below with respect to FIG. 5, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

Figure 5:
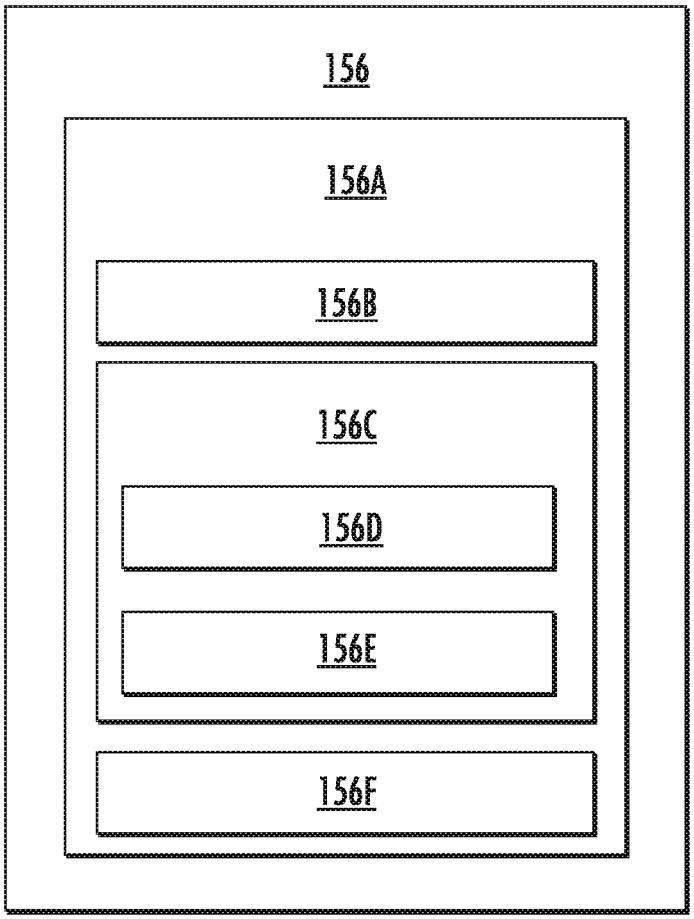
FIG. 5 depicts certain components of a controller according to example embodiments of the present subject matter.

FIG. 5 depicts certain components of controller 156 according to example embodiments of the present disclosure. Controller 156 can include one or more computing device(s) 156A which may be used to implement methods as described herein. Computing device(s) 156A can include one or more processor(s) 156B and one or more memory device(s) 156C. The one or more processor(s) 156B can include any suitable processing device, such as a microprocessor, microcontroller, integrated circuit, an application specific integrated circuit (ASIC), a digital signal processor (DSP), a field-programmable gate array (FPGA), logic device, one or more central processing units (CPUs), graphics processing units (GPUs) (e.g., dedicated to efficiently rendering images), processing units performing other specialized calculations, etc. The memory device(s) 156C can include one or more non-transitory computer-readable storage medium(s), such as RAM, ROM, EEPROM, EPROM, flash memory devices, magnetic disks, etc., and/or combinations thereof.

The memory device(s) 156C can include one or more computer-readable media and can store information accessible by the one or more processor(s) 156B, including instructions 156D that can be executed by the one or more processor(s) 156B. For instance, the memory device(s) 156C can store instructions 156D for running one or more software applications, displaying a user interface, receiving user input, processing user input, etc. In some implementations, the instructions 156D can be executed by the one or more processor(s) 156B to cause the one or more processor(s) 156B to perform operations, e.g., such as one or more portions of methods described herein. The instructions 156D can be software written in any suitable programming language or can be implemented in hardware. Additionally, and/or alternatively, the instructions 156D can be executed in logically and/or virtually separate threads on processor(s) 156B.

The one or more memory device(s) 156C can also store data 156E that can be retrieved, manipulated, created, or stored by the one or more processor(s) 156B. The data 156E can include, for instance, data to facilitate performance of methods described herein. The data 156E can be stored in one or more database(s). The one or more database(s) can be connected to controller 156 by a high bandwidth LAN or WAN, or can also be connected to controller through network(s) (not shown). The one or more database(s) can be split up so that they are located in multiple locales. In some implementations, the data 156E can be received from another device.

The computing device(s) 156A can also include a communication module or interface 156F used to communicate with one or more other component(s) of controller 156 or washing machine appliance 100 over the network(s). The communication interface 156F can include any suitable components for interfacing with one or more network(s), including for example, transmitters, receivers, ports, controllers, antennas, or other suitable components.

During operation of washing machine appliance 100, laundry items are loaded into wash basket 112 through opening 116, and washing operation is initiated through operator manipulation of input selectors 152. Wash basket 112 is filled with water and detergent and/or other fluid additives via primary dispenser 110. One or more valves can be controlled by washing machine appliance 100 to provide for filling wash tub 108 and wash basket 112 to the appropriate level for the amount of articles being washed and/or rinsed. By way of example for a wash mode, once wash basket 112 is properly filled with fluid, the contents of wash basket 112 can be agitated (e.g., with agitation element 132 as discussed previously) for washing of laundry items in wash basket 112.

More specifically, referring again to FIGS. 3 and 4, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 114. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108. In addition, washing machine appliance 100 may include one or more pressure sensors 170 for detecting the amount of water and or clothes within wash tub 108. For example, pressure sensor 170 may be operably coupled to a side of tub 108 for detecting the weight of wash tub 108, which controller 156 may use to determine a volume of water in wash chamber 114 and a subwasher load weight, as described below.

After wash tub 108 is filled and the agitation phase of the wash cycle is completed, wash basket 112 can be drained, e.g., by drain pump assembly 130. Laundry articles can then be rinsed by again adding fluid to wash basket 112 depending on the specifics of the cleaning cycle selected by a user. The impeller or agitation element 132 may again provide agitation within wash basket 112. One or more spin cycles may also be used as part of the cleaning process. In particular, a spin cycle may be applied after the wash cycle and/or after the rinse cycle in order to wring wash fluid from the articles being washed. During a spin cycle, wash basket 112 is rotated at relatively high speeds to help wring fluid from the laundry articles through perforations 126. After articles disposed in wash basket 112 are cleaned and/or washed, the user can remove the articles from wash basket 112, e.g., by reaching into wash basket 112 through opening 116.

Referring still to FIGS. 3 and 4, one or more measurement devices 172 may be provided in the washing machine appliance 100 for measuring movement of wash tub 108, in particular during rotation of wash basket 112 prior to the spin cycle. Specifically, for example, movement of wash tub 108 may be measured as one or more displacement readings, e.g., certain displacement amplitudes measured at the center of gravity of wash tub 108. Measurement devices 172 may measure a variety of suitable variables that can be correlated to movement of wash tub 108. The movement measured by such devices 172 can be utilized to, e.g., monitor the load balance state of wash tub 108, determine the displacement amplitudes of wash tub 108 at the center of gravity or other locations, and to adjust operation of washing machine appliance 100 to facilitate agitation in a particular manner and/or for particular time periods to adjust the load balance state, e.g., to attempt to balance articles within wash basket 112.

A measurement device 172 in accordance with the present disclosure may include an accelerometer which measures translational motion, such as acceleration along one or more directions. Additionally or alternatively, a measurement device 172 may include a gyroscope, which measures rotational motion, such as rotational velocity about an axis. Moreover, according to exemplary embodiments, a measurement device 172 may include more than one gyroscope and/or more than one accelerometer.

Control panel 150 and other components of washing machine appliance 100, such as drive assembly 138 and measurement device 172, may be in communication with controller 156 via one or more signal lines or shared communication busses. Optionally, measurement device 172 may be included with controller 156 or may alternatively be a printed circuit board that includes the gyroscope and accelerometer thereon. According to exemplary embodiments, measurement devices 172 may include a dedicated microprocessor that performs the calculations specific to the measurement of motion with the calculation results being used by controller 156.

According to the illustrated embodiment, measurement device 172 is mounted to wash tub 108 to sense movement of wash tub 108 relative to the cabinet 102, e.g., by measuring uniform periodic motion, non-uniform periodic motion, or excursions of the tub 108 during appliance 100 operation. For instance, movement may be measured as discrete identifiable components (e.g., in a predetermined direction). More specifically, according to the illustrated embodiment, measurement device 172 is mounted to a bottom wall of wash tub 108, though other suitable positions on subwasher 146 are possible. Controller 156 may use measurement device 172 to determine the movement of any other position on wash tub 108, such as the center of gravity of wash tub 108. However, it should be appreciated that according to alternative embodiments, any suitable number, type, and position of measurement devices may be used.

The measurement device 172 may be mounted to wash tub 108 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to wash tub 108 at a single location (e.g., the location of the printed circuit board or other component of the measurement device 172 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location.

For example, a gyroscope located at one location on wash tub 108 can measure the rotation of a gyroscope located at a different location on tub 108, because rotation about a given axis is the same everywhere on a solid object such as wash tub 108.

Now that the construction of washing machine appliance 100 and the configuration of controller 156 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Figure 6:
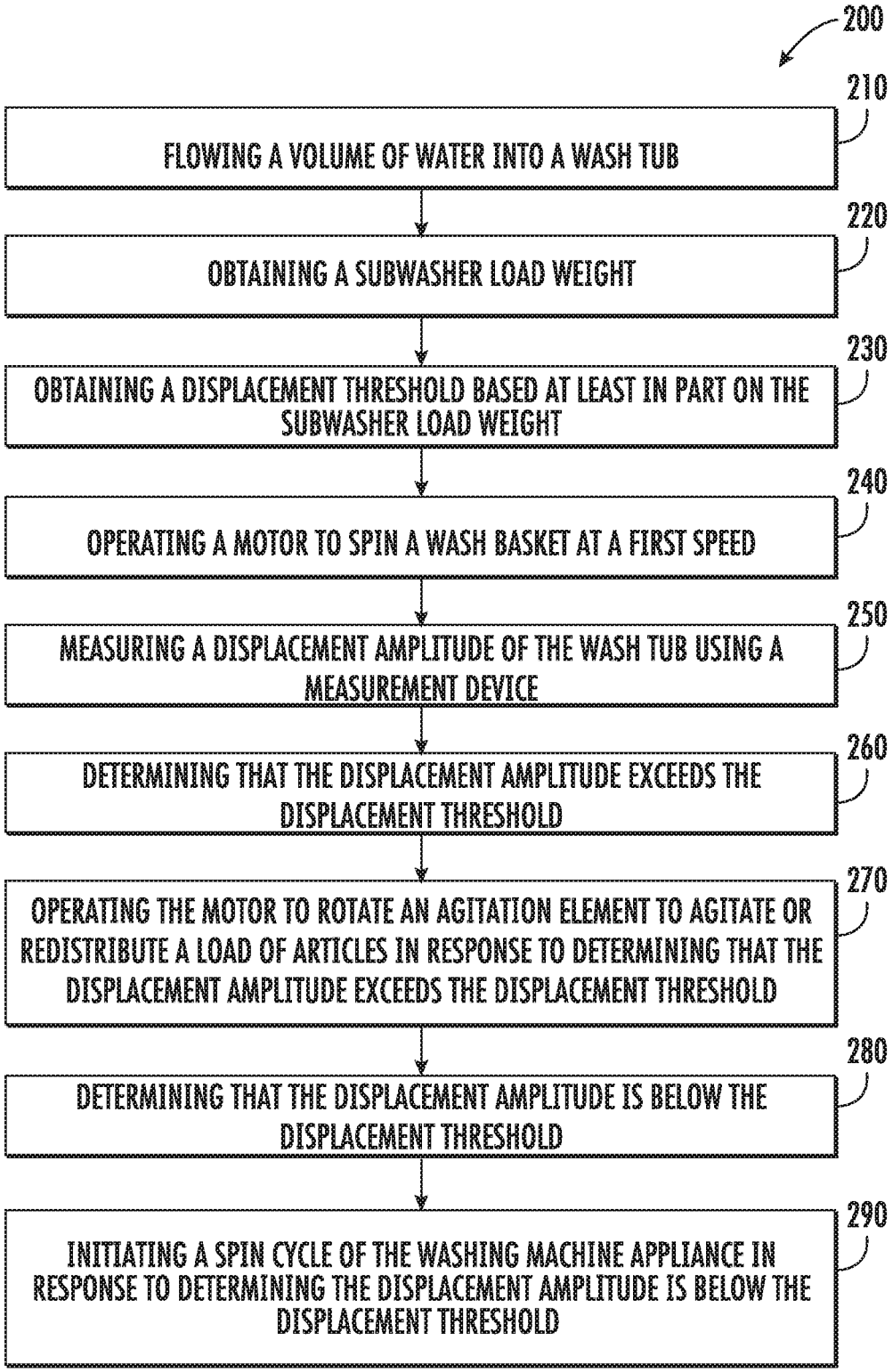
FIG. 6 illustrates a method for controlling a washing machine appliance in accordance with one embodiment of the present disclosure.

Referring now to FIG. 6, method 200 includes, at step 210, flowing a volume of water into a wash tub. In this regard, for example, controller 156 may regulate water control valve 166 to dispense a predetermined amount of water from water supply source 162 into wash tub 108 through discharge nozzle 164. According to an exemplary embodiment, step 210 is performed after wash tub 108 has been drained, but prior to a spin cycle of washing machine appliance 100. Specifically, for example, water from an initial agitation or wash cycle could be used to perform the out-of-balance detection, e.g., to prevent the need for filling up wash tub 108 again. In this manner, an out of balance detection procedure may be performed prior to spinning wash basket 112 at high speeds during the spin cycle, thereby reducing the likelihood of excessive tub displacement, vibrations, noise, and impact.

Step 220 includes determining a subwasher load weight. As explained above, subwasher 146 is used generally herein to refer to the load suspended by suspension system 144 within cabinet 102. Thus, the subwasher load weight measured at step 220 generally includes the weight of the load of dry clothes and the water added to wash tub 108. In determining the subwasher load weight, the weight of wash tub 108, drive assembly 138, wash basket 112, agitation element 132, and other fixed component weights are not included in the subwasher load weight.

According to an exemplary embodiment, obtaining the subwasher load weight includes determining a dry weight of the load of articles within wash basket 112 before flowing water into wash tub 108. The dry weight may be determined in any suitable manner, e.g., by accelerating wash basket 112 and measuring a motor current, a motor voltage, and/or a time to reach a specific speed. Other methods for determining the dry weight of the load of articles in wash basket 112 are known and contemplated as within the scope of the present subject matter.

After determining the dry weight of the load of articles the predetermined volume of water is added to the wash tub (step 210) and its weight is determined. More specifically, according to an exemplary embodiment, the known volume (e.g., in gallons) of water is multiplied by conversion factor (e.g., in pounds per gallon) to determine the weight of water, e.g., in pounds. The total subwasher load weight, referred to herein as $W_{SW}$, is the sum of the dry weight of the load of articles and the weight of the added water.

Step 230 includes obtaining a displacement threshold ($\delta_{LMT}$) based at least in part on the subwasher load weight ($W_{SW}$). In general, the displacement threshold ($\delta_{LMT}$) may represent a limit in the amount of displacement permissible at the center of gravity of wash tub 108 to prevent undesirable vibrations, noise, or tub contact during a spin cycle of washing machine appliance 100. Although the actual displacements and the displacement threshold ($\delta_{LMT}$) of wash tub 108 are described herein in reference to a center of gravity of wash tub 108, it should be appreciated that according to alternative embodiments the displacement and thresholds could be measured at any other suitable location.

According to an exemplary embodiment, the displacement threshold ($\delta_{LMT}$) may be determined as a function of an out of balance weight threshold ($W_{OOB}$) and a sub washer weight ($W_{SW}$, e.g., as determined at step 220). Notably, the out of balance weight threshold ($W_{OOB}$) may generally be appliance specific. For example, some washing machine appliances may be configured for withstanding a 2 pound out of balance, while others may be capable of withstanding up to a 10 pound out of balance.

Specifically, according to an exemplary embodiment, the displacement threshold ($\delta_{LMT}$) may be calculated using the following equation:

$$\delta_{LMT}=W_{OOB}(C_1+C_2\cdot W_{SW})$$

where:

$\delta_{LMT}$=the displacement threshold;

$W_{OOB}$=the out-of-balance weight threshold;

$C_1$=a subwasher weight intercept coefficient;

$C_2$=a subwasher weight slope coefficient; and $W_{SW}$=the subwasher weight.

Figure 7:
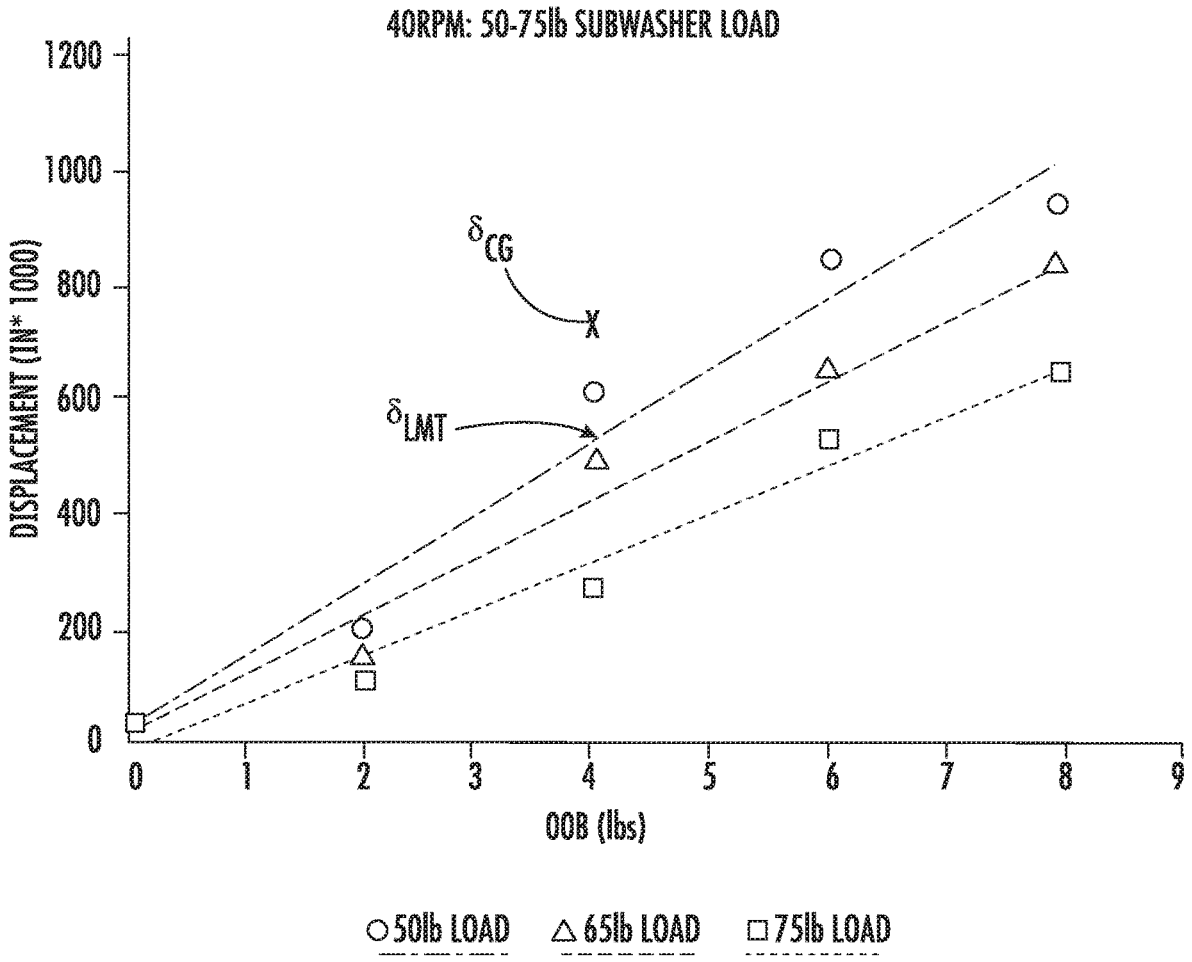
FIG. 7 provides a plot illustrating the relationship between a tub displacement, a subwasher weight, and a displacement threshold for the exemplary washing machine appliance of FIG. 1.

Referring now briefly to FIG. 7, a plot illustrating the relationship set forth in the above equation is provided. For purposes of explanation, this plot is associated with the operation of washing machine appliance 100 with a subwasher weight of between 50 and 75 pounds rotated at 40 RPM. As shown, the displacement threshold ($\delta_{LMT}$) is equivalent to the line of best fit associated with the subwasher load weight (e.g., 50, 65, or 75 pounds) and the out-of-balance weight threshold ($W_{OOB}$) for the appliance. Notably, linear interpolation may be used to determine the displacement threshold ($\delta_{LMT}$) for loads having a weight in between those shown. It should also be appreciated that the relationship illustrated is only exemplary and not intended to limit the scope of the present subject matter.

In addition, constants $C_1$ and $C_2$ may be known or empirically determined constants that are a function of the washing machine configuration and may depend, for example, on the out-of-balance weight threshold ($W_{OOB}$) of a washing machine appliance and/or the basket speed at which the out of balance detection is performed (e.g., the first speed as described below). Furthermore, it should be appreciated that the constants described below are only exemplary and may be scaled, e.g., by 1000 or any other suitable value. According to an exemplary embodiment, constants $C_1$ and $C_2$ may be determined using the table below for washing machine appliance 100 having an out of balance threshold of approximately 4 pounds.

| Basket Speed (RPM) | $C_1$ | $C_2$ |
|---|---|---|
| 40 | 229.2 | −1.975 |
| 45 | 272.2 | −1.901 |

After obtaining a displacement threshold ($\delta_{LMT}$) at step 230 using the equation above, step 240 includes operating a motor (e.g. drive motor 140) to spin wash basket 112 at a first speed. According to exemplary embodiments, the first speed is a predetermined speed that is lower than a spin cycle basket speed. In addition, the first speed may depend on the measured subwasher weight ($W_{SW}$). In this regard, because the displacement at the center of gravity of wash tub 108 decays linearly with increasing subwasher weight ($W_{SW}$), the first speed may be selected based on subwasher weight ($W_{SW}$) to provide the largest displacement amplitude without causing wash tub 108 to strike cabinet 102. For example, as shown in the table above, if the subwasher weight ($W_{SW}$) is less than 75 pounds, the first speed should be 40 RPM, whereas if the subwasher weight ($W_{SW}$) is greater than 75 pounds the basket speed should be 45 RPM. It should be appreciated that these subwasher weight values and basket speeds are only used for the purpose of explanation. Other appliances and embodiments may include different values for the first speeds, the subwasher weights, the system constants, the out of balance thresholds, etc.

Method 200 further includes, at step 250, measuring a displacement amplitude ($\delta_{CG}$) of the wash tub using a measurement device. Continuing the example from above, measurement device 172 may be used to measure the displacement amplitude ($\delta_{CG}$) at the center of gravity of wash tub 108. As may be appreciated by one skilled in the art, by placing measurement device 172 on the bottom of wash tub 108 (e.g., a rigid body), measurements obtained such as displacement and rotation at the mounting location may be used to determine the displacement and rotation at the center of gravity using a transfer function based on the geometry of wash tub 108.

Step 260 includes determining that the displacement amplitude ($\delta_{CG}$) exceeds the displacement threshold ($\delta_{LMT}$). For example, referring again briefly to FIG. 7, the displacement amplitude ($\delta_{CG}$) is illustrated above or exceeding the displacement threshold ($\delta_{LMT}$) for a four pound out-of-balance weight threshold ($W_{OOB}$). In this regard, a comparison is made between the actual measured displacement at the center of gravity ($\delta_{CG}$) and the maximum desired displacement threshold ($\delta_{LMT}$, e.g., determined at step 230). Step 270 includes operating the motor to rotate an agitation element in response to determining that the displacement amplitude ($\delta_{CG}$) exceeds the displacement threshold ($\delta_{LMT}$). In this manner, the agitation element may act to agitate or redistribute the load of articles in wash tub 108 prior to entering the spin cycle, thereby avoiding issues associated with operating an at high speeds with an out of balance load.

After the load of articles is redistributed within wash tub 108, washing machine appliance 100 may repeat the out of balance detection process by starting at step 240 and operating the motor to spin wash basket 112 at the first speed again. This process may be repeated until the clothes are redistributed sufficiently to reduce the measured displacement amplitude ($\delta_{CG}$) below the displacement threshold ($\delta_{LMT}$). According to an exemplary embodiment, this process may be limited to a certain predetermined number of attempts. If the displacement amplitude ($\delta_{CG}$) still exceeds the displacement threshold ($\delta_{LMT}$) after the predetermined number of attempts, the cycle may be terminated or the spin cycle may be entered despite the out-of-balance condition.

At this point, method 200 may further include, at step 280, determining that the displacement amplitude ($\delta_{CG}$) is below the displacement threshold ($\delta_{LMT}$). Step 290 further includes initiating a spin cycle of washing machine appliance in response to determining that the displacement amplitude ($\delta_{CG}$) is below the displacement threshold ($\delta_{LMT}$). In general, initiating the spin cycle may include using a drain pump assembly (e.g., drain pump assembly 130) to drain the water from wash tub 108. The spin cycle may then include operating the motor to spin the wash basket at a second speed that is higher than the first speed.

Although the discussion herein refers to method 200 for operating washing machine appliance 100, one skilled in the art will appreciate that the features and configurations described may be used for operating other washing machine appliances in other manners. For example, method 200 may be used to operate a horizontal axis washing machine appliance, the out-of-balance weight thresholds may vary, system constants ($C_1$, $C_2$) may be different, measurement devices 172 may be positioned at different locations, etc. Other variations and modifications of the exemplary embodiment described below are possible, and such variations are contemplated as within the scope of the present subject matter.

FIG. 6 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

Figure 8:
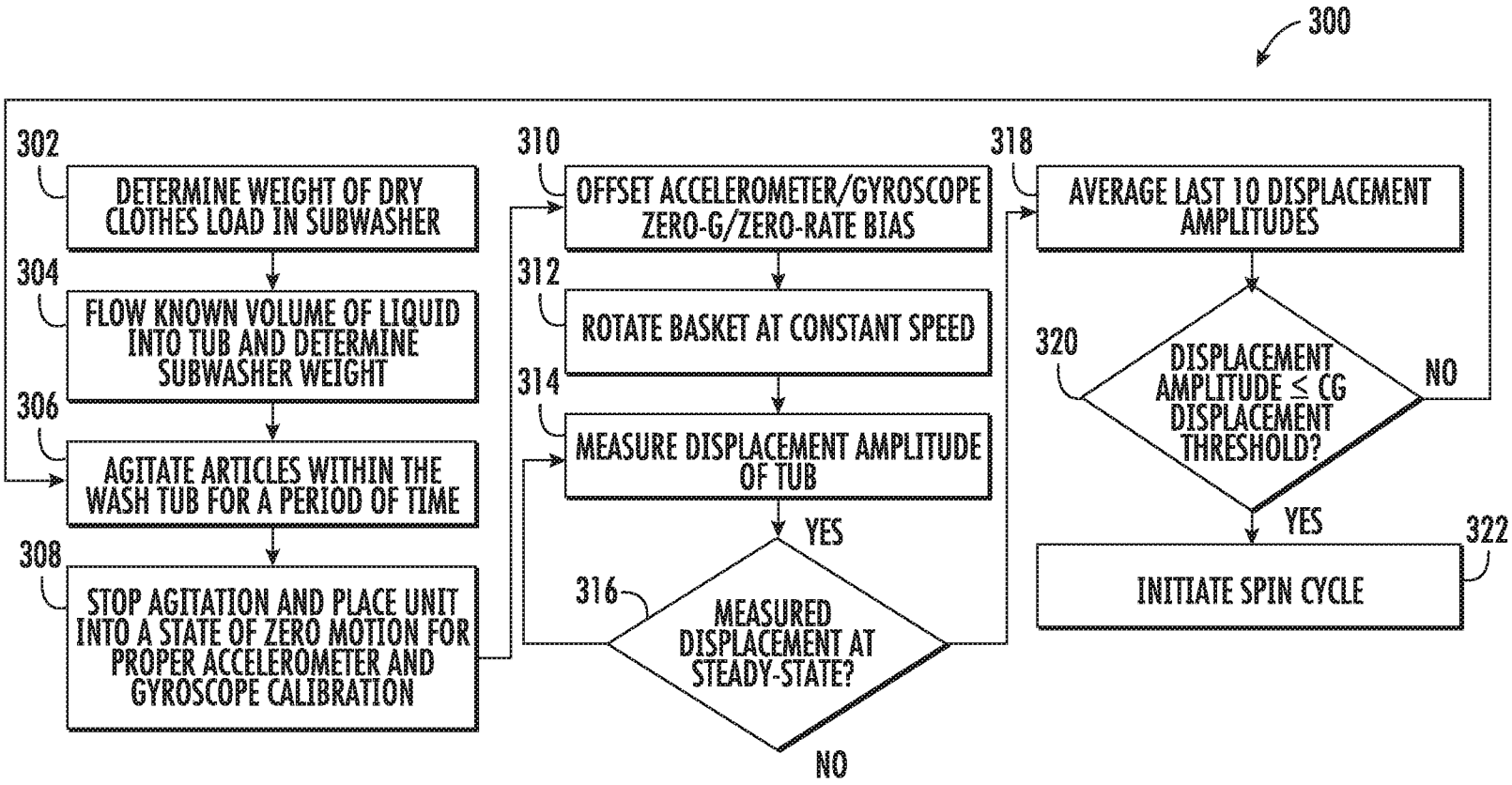
FIG. 8 illustrates an exemplary decision tree or flow diagram of an operating method of the washing machine appliance of FIG. 1 according to an exemplary embodiment of the present subject matter.

Referring now to FIG. 8, an exemplary illustration of the decision making process or control method implemented by controller 156 to perform method 200 is illustrated. It should be appreciated that the flow diagram 300 is intended only to provide a simple illustration of an exemplary control method. The flow diagram 300 is not intended to limit the scope of the present subject matter in any manner.

As shown, after the cycle is initiated, the controller performs a dry load sense procedure (302) to determine a size or dry weight of a wash load, e.g., in pounds. For example, controller may use a pressure sensor to detect the load weight after a wash load is added but prior to adding water. The controller may then add some amount of water and calculate the subwasher weight (304).

After the subwasher weight is determined, drive motor may rotate the agitation element to agitate articles within the wash tub for a specific period of time (306), e.g., to distribute the load about the axis of rotation. After the load is distributed, steps 308 and 310 define an optional calibration process for the measurement devices for measuring displacement amplitude. For example, washing machine appliance may stop agitation and allow the agitation element and wash basket to stop moving in order to zero out the accelerometer and/or gyroscope.

Once calibration is complete, drive motor may rotate wash basket at a constant, low-speed (312), e.g. to facilitate the out of balance detection or sensing procedure. Steps 314 through 318 define a tub displacement measurement procedure. For example, step 314 includes measuring the displacement amplitude of the tub. According to an exemplary embodiment, step 316 may include waiting for the tub displacement to reach steady state. For example, according to one embodiment, step (316) may include measuring multiple displacement amplitudes within a given time and comparing the measured values with each other to make sure that they are within the threshold percentage of each other, e.g., to avoid erroneous measurements or statistical errors. According to an exemplary embodiment, step 318 may include averaging the last ten measured displacement amplitudes to obtain a true and accurate measure of the displacement of the center of gravity of the wash tub. According to alternative embodiments, a single displacement amplitude may be measured once steady state is reached.

Step 320 includes comparing the displacement amplitude (or an averaged displacement amplitude) to a displacement threshold to determine whether the out of balance condition exceeds an appliance threshold. Specifically, the displacement threshold may be calculated in a manner similar to that described above as a function of the out of balance threshold for a given appliance and the sub washer weight (e.g., determined at step 304). If the displacement value measured at step 318 is less than the displacement threshold, the controller may determine that the out of balance within the wash basket does not exceed the appliance threshold. At this point, controller may then complete the operating cycle, e.g., by performing a spin cycle (322). By contrast, if the displacement amplitude exceeds the displacement threshold, the controller may reenter the agitation process (e.g., step 306) in an attempt to redistribute the load again. This procedure may continue until the out of balance in wash basket is below the desired threshold out of balance for the washing machine. It should be appreciated that the procedure illustrated by diagram 300 may omit certain steps for simplicity of discussion. Variations and modifications to this control method are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance comprising a wash tub, a wash basket rotatably mounted within the wash tub for receiving a load of articles, an agitation element rotatably mounted within the wash basket, a measurement device mounted to the wash tub, and a motor mechanically coupled to the wash basket and the agitation element, the method comprising:

flowing a volume of water into the wash tub;

obtaining a wet load weight;

obtaining a displacement threshold based at least in part on the wet load weight;

operating the motor to spin the wash basket at a first speed;

measuring a displacement amplitude of the wash tub using the measurement device, wherein the displacement amplitude comprises at least one of the displacement or rotation of the wash tub;

determining that the displacement amplitude exceeds the displacement threshold; and operating the motor to rotate the agitation element to agitate or redistribute the load of articles in response to determining that the displacement amplitude exceeds the displacement threshold.

2. The method of claim 1, further comprising:

determining that the displacement amplitude is below the displacement threshold; and initiating a spin cycle of the washing machine appliance in response to determining the displacement amplitude is below the displacement threshold.

3. The method of claim 2, wherein initiating the spin cycle comprises:

draining the water from the wash tub using a drain pump assembly; and operating the motor to spin the wash basket at a second speed, the second speed being higher than the first speed.

4. The method of claim 1, wherein obtaining the displacement threshold comprises using the following equation:

$$\delta_{LMT}=W_{OOB}\cdot(C_1+C_2W_{SW})$$

where:

$\delta_{LMT}$=the displacement threshold;

$W_{OOB}$=the out-of-balance weight threshold;

$C_1$=a subwasher weight intercept coefficient;

$C_2$=a subwasher weight slope coefficient; and $W_{SW}$=the subwasher wet load weight.

5. The method of claim 4, wherein the subwasher weight intercept coefficient ($C_1$) is substantially equivalent to 250 and the subwasher weight slope coefficient ($C_2$) is substantially equivalent to −1.95.

6. The method of claim 1, wherein the first speed is determined based on the wet load weight.

7. The method of claim 6, wherein the first speed is 40 revolutions per minute if the wet load weight is less than 75 pounds.

8. The method of claim 6, wherein the first speed is 45 revolutions per minute if the wet load weight is greater than 75 pounds.

9. The method of claim 1, further comprising:

determining a dry weight of the load of articles before flowing the volume of water into the wash tub; and determining a weight of the water added to the wash tub, wherein the wet load load weight is obtained by adding the dry weight of the load of articles and the weight of water added to the wash tub.

10. The method of claim 9, wherein determining the dry weight of the load of articles comprises operating the motor to accelerate the wash basket and measuring at least one of a motor current and a motor voltage.

11. The method of claim 9, wherein determining the weight of the water comprises monitoring the volume of water added to the wash tub and multiplying by a conversion factor.

12. A washing machine appliance, comprising:

a wash tub positioned within a cabinet;

a wash basket rotatably mounted within the wash tub, the wash basket defining a wash chamber for receipt of a load of articles for washing;

an agitation element positioned in the wash basket;

a motor in mechanical communication with the wash basket and the agitation element, the motor being configured for selectively rotating the wash basket and the agitation element within the wash tub;

a measurement device mounted to the wash tub;

a water control valve for regulating a flow of water from a water supply into the wash tub; and a controller in operative communication with the motor, the measurement device, and the water control valve, the controller being configured for:

regulating the water control valve to flow a volume of water into the wash tub;

obtaining a wet load weight;

obtaining a displacement threshold based at least in part on the wet load weight, wherein the displacement amplitude comprises at least one of the displacement or rotation of the wash tub;

operating the motor to spin the wash basket at a first speed;

measuring a displacement amplitude of the wash tub using the measurement device;

determining that the displacement amplitude exceeds the displacement threshold; and operating the motor to rotate the agitation element and agitate or redistribute the load of articles in response to determining that the displacement amplitude exceeds the displacement threshold.

13. The washing machine appliance of claim 12, wherein the controller is further configured for:

determining that the displacement amplitude is below the displacement threshold; and initiating a spin cycle of the washing machine appliance in response to determining the displacement amplitude is below the displacement threshold.

14. The washing machine appliance of claim 13, wherein initiating the spin cycle comprises:

draining the water from the wash tub using a drain pump assembly; and operating the motor to spin the wash basket at a second speed, the second speed being higher than the first speed.

15. The washing machine appliance of claim 12, wherein obtaining the displacement threshold comprises using the following equation:

$$\delta_{LMT}=W_{OOB}\cdot(C_1+C_2\cdot W_{SW})$$

where:

$\delta_{LMT}$=the displacement threshold;

$W_{OOB}$=the out-of-balance weight threshold;

$C_1$=a subwasher weight intercept coefficient;

$C_2$=a subwasher weight slope coefficient; and $W_{SW}$=the wet load weight.

16. The washing machine appliance of claim 12, wherein the first speed is determined based on the wet weight.

17. The washing machine appliance of claim 12, wherein the controller is further configured for:

determining a dry weight of the load of articles before flowing the volume of water into the wash tub; and determining a weight of the water added to the wash tub, wherein the wet load weight is obtained by adding the dry weight of the load of articles and the weight of water added to the wash tub.

18. The washing machine appliance of claim 12, comprising:

a pressure sensor operably coupled to the wash tub, and wherein determining the weight of the water comprises measuring a tub water level using the pressure sensor.

19. The washing machine appliance of claim 12, wherein the measurement device comprises an accelerometer and a gyroscope.

20. The washing machine appliance of claim 12, wherein the washing machine appliance is a top load washing machine appliance.

* * * * *